United States Patent [19]

McConnell et al.

[11] 4,206,330

[45] Jun. 3, 1980

[54] MOVING CONTACT FOR RADIAL BLOW-IN EFFECT FOR ARC SPINNER INTERRUPTER

[75] Inventors: Lorne D. McConnell, Chalfont; Gerald A. Votta, King of Prussia; Donald E. Weston, Lansdale, all of Pa.

[73] Assignee: Gould Inc., Rolling Meadows, Ill.

[21] Appl. No.: 868,624

[22] Filed: Jan. 11, 1978

[51] Int. Cl.[2] ..... H01H 33/18

[52] U.S. Cl. ..... 200/147 R; 200/148 B

[58] Field of Search ..... 200/148 R, 148 A, 148 B, 200/148 G, 147 R, 144 A, 147 A, 147 B, 144 B

[56] References Cited

U.S. PATENT DOCUMENTS

| | | | |
|---|---|---|---|
| 3,366,762 | 1/1968 | Smith, Jr. | 200/144 B |
| 4,052,576 | 10/1977 | Smith | 200/147 R |
| 4,052,577 | 10/1977 | Votta | 200/147 R |
| 4,079,219 | 3/1978 | Weston | 200/148 A |

*Primary Examiner*—J. V. Truhe
*Assistant Examiner*—Morris Ginsburg
*Attorney, Agent, or Firm*—Ostrolenk, Faber, Gerb & Soffen

[57] ABSTRACT

A contact construction is disclosed for a circuit interrupter of the type in which an arc drawn between cooperating arcing contacts is caused to circulate around an axis and through a dielectric gas in order to extinguish the arc. The movable contact is so constructed that the current path is directed radially relative to the contact axis so that a magnetic force is applied radially inward to the arc which roots on the movable contact. This magnetic force tends to move the arc root on the movable contact to the innermost radial position on the movable contact. The arc is also forced in a direction away from exteriorly positioned main contact components.

13 Claims, 13 Drawing Figures

MOVING CONTACT FOR RADIAL BLOW-IN EFFECT FOR ARC SPINNER INTERRUPTER

RELATED APPLICATIONS

This application is related to copending application Ser. No. 868,623, filed Jan. 11, 1978, in the names of Robert Kirkland Smith and Gerald A. Votta, entitled THIN ARC RUNNER FOR ARC SPINNER INTERRUPTER; Ser. No. 868,622, filed Jan. 11, 1978, in the name of Robert Kirkland Smith, entitled EXTERIOR CONNECTED ARC RUNNER FOR ARC SPINNER INTERRUPTER; and Ser. No. 868,621, filed Jan. 11, 1978, in the names of Ruben D. Garzon, Lorne D. McConnell and Gerald A. Votta, entitled MOVING CONTACT FOR LOCALIZED GAS FLOW ARC SPINNER TYPE INTERRUPTER, all of which are assigned to the assignee of the present invention.

BACKGROUND OF THE INVENTION

This invention relates to circuit interrupters, and more specifically relates to circuit interrupters of the type in which an arc is drawn in a relatively stationary dielectric gas and the arc is then caused to rotate rapidly within the gas in order to cool the arc so it can extinguish at the next arc current zero.

Arc spinner type interrupters are known in the art and are typically shown in U.S. Pat. No. 4,052,577, in the name of Gerald A. Votta, as well as U.S. Pat. No. 4,052,576, in the name of Robert Kirkland Smith.

In circuit interrupters of the above type, an arc is drawn between a circular arc runner and a relatively movable contact which moves into and out of engagement with the arc runner. The disk-shaped arc runner is associated with a closely coupled series-connected, coaxial coil which carries the arcing current and which also induces a circulating current in the arc runner. The magnetic field produced by the circulating current in the arc runner and by the coil interact with the arc current in the arcing space to create a Lorentz force which tends to rotate or spin the arc around the arc runner and relative to the dielectric gas which fills the arc space. The relative motion between the arc and the gas then causes the cooling and deionization of the arc, to allow extinction of the arc at an arc current zero.

In prior art type constructions, it has been common that the current path through the relatively movable contact from the arc root point to the main current path has a radial segment relative to the central axis about which the arc rotates. This section was directed to produce a magnetic force on the arc root which tends to move the arc root on the movable contact radially outwardly. This can then lead to major restrikes across the main contacts since the main contacts are normally disposed radially outwardly of the arcing region. Moreover, this configuration causes a general loss of control of the arc position and of the arc length and increases the amount of arc energy which is applied to the gas.

BRIEF DESCRIPTION OF THE PRESENT INVENTION

In accordance with the present invention, the movable arcing contact is so constructed that the current path from the arc root region to the main contact extends radially outwardly of the arc root location and of the central axis about which the arc is rotated. This then creates a bend in the current path through the arcing contact and to the arc itself which produces a radially inwardly directed magnetic force which tends to move the arc and its arc root radially inwardly of the arcing space. The arcing contact has a central opening which is coaxial with the axis of rotation of the arc and the magnetic force causes the arc root to locate and to rotate around the inner diameter of the arcing contact. That is, the arc root and arc are forced radially inward so that the arc is well controlled in position on the interior of the arcing contact and the arc length is accurately maintained. Moreover, the arc tends to move in a direction away from the external main contacts so that the novel invention tends to prevent restrike to the main contacts.

DETAILED DESCRIPTION OF THE DRAWINGS

Figure 1:
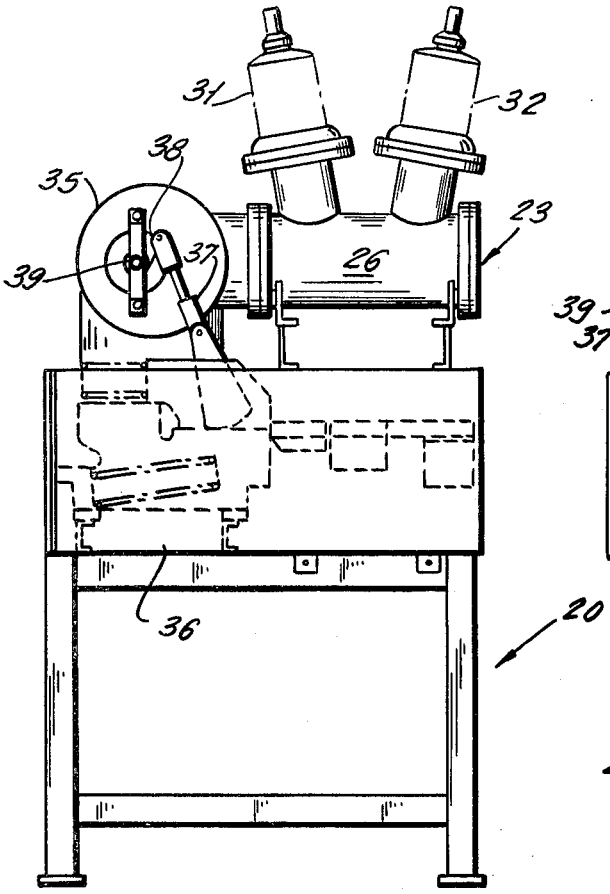
FIG. 1 is a side elevational view of a circuit breaker which could incorporate the concept of the present invention.
Figure 2:
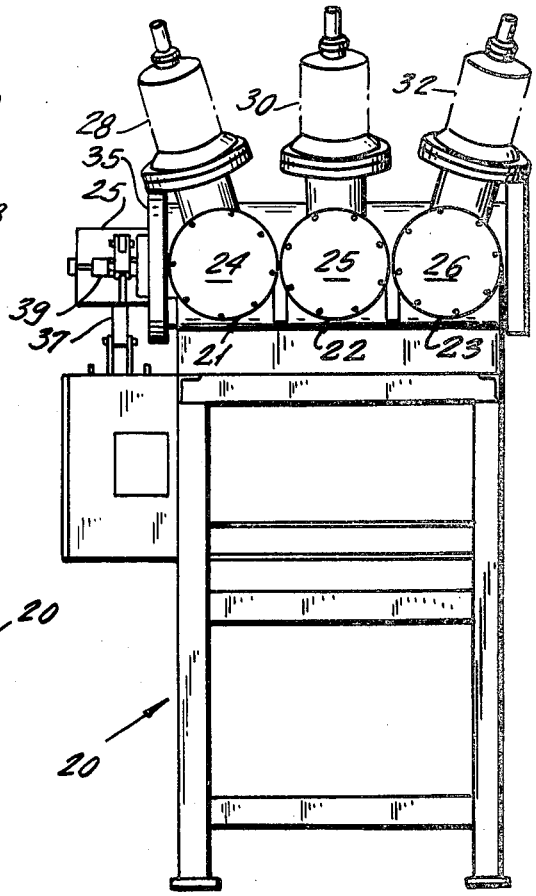
FIG. 2 is a front elevational view of FIG. 1.
Figure 3:
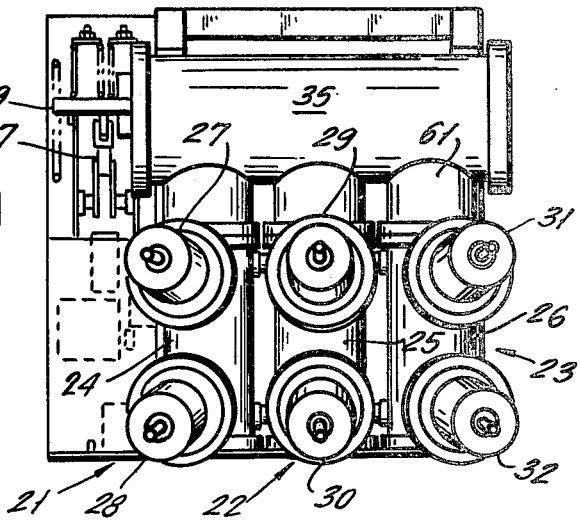
FIG. 3 is a top view of FIGS. 1 and 2.

FIGS. 1 to 3 illustrate a typical circuit breaker which uses circuit interrupters of the type constructed in accordance with the present invention. Referring to FIGS. 1 to 3, the circuit breaker is mounted on a steel support frame 20 and is shown as a three-phase circuit breaker containing phases 21, 22 and 23. Each of phases 21, 22 and 23 consist of identical interrupters, one of which will be described more fully hereinafter, contained in respective aluminum tanks 24, 25 and 26, which have terminal bushings 27–28, 29–30 and 31–32, respectively. Each of housings 24, 25 and 26 are capped at their right-hand end in FIG. 1 and communicate with an operating mechanism housing 35, which may include a jack-shaft linkage which is coupled to the interrupters within each of housings 24, 25 and 26. The operating mechanism is operable to simultaneously open and close the three interrupters. Any suitable spring closing mechanism or the like, shown as the spring closing mechanism 36, can be used to apply the input energy for the jack-shaft linkage in housing 35. Thus, an operating link 37 extending from the spring mechanism 36 is connected to an operating link 38 (FIG. 1) which in turn rotates shaft 39 which is coupled to the interrupters of each phase as will be more fully described hereinafter.

It is necessary that the housing 35 be sealed since it will be filled with a suitable dielectric gas such as sulfur hexafluoride and permits communication of the insulating gas between the interiors of all housings 24, 25 and 26.

The circuit breaker described above is suitable for use in connection with a 15kV/25kA three-phase circuit breaker and can have a total height of about 82 inches and a total width in FIG. 1 of about 38 inches.

Figure 4B:
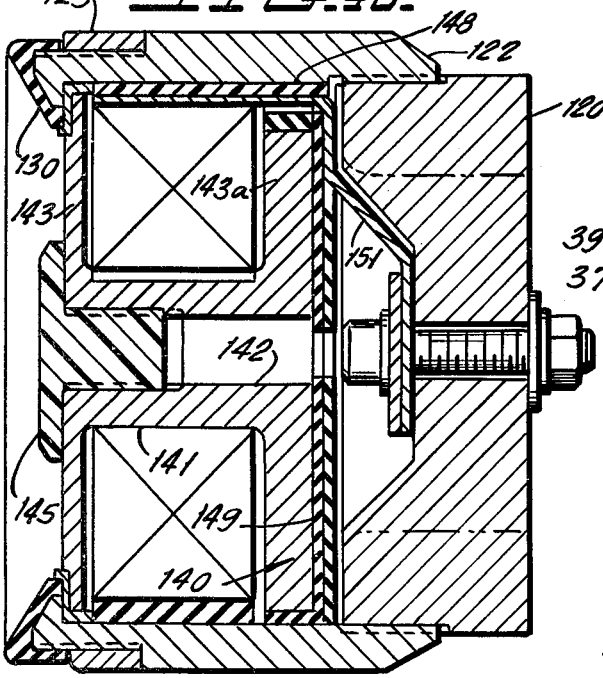
FIG. 4*b* is an enlarged cross-sectional diagram of the coil assembly of FIG. 4.
Figures 4, 4A:
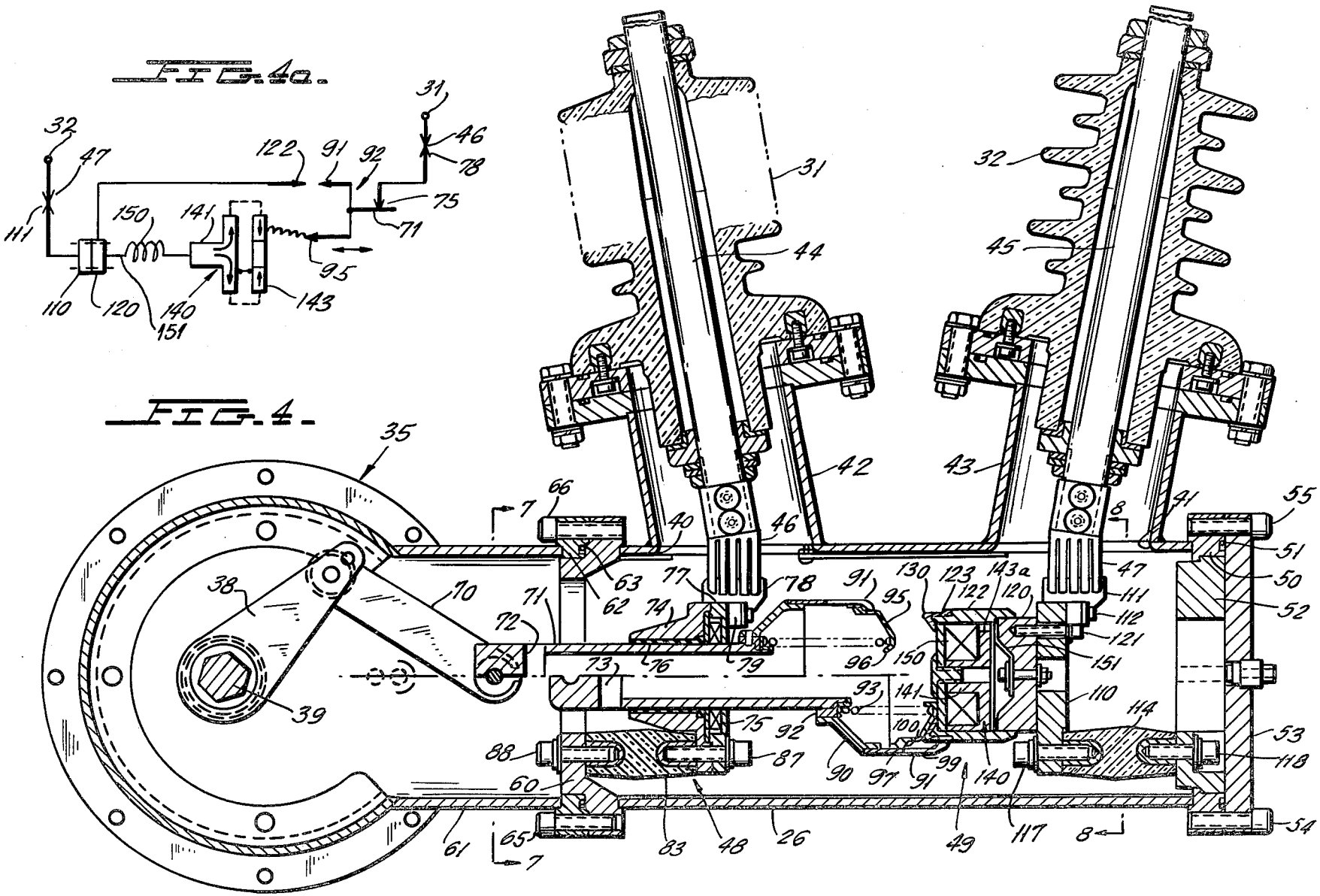
FIG. 4 is a cross-sectional view taken along the axis of one of the three interrrupters of FIGS. 1, 2 and 3 and illustrates an interrupter with a center-fed arc runner and shows the interrupter open above the center axis and closed below the center axis.
FIG. 4*a* is an electrical circuit diagram of the structure shown in FIG. 4.

The interior of the interrupter for each phase is shown in FIG. 4 for the case of phase 23 encased by housing 26. Housing 26 may be of steel or of any other desired material and contains two openings 40 and 41 for receiving the bushings 31 and 32. Thus, openings 40 and 41 have short tubes 42 and 43, respectively, welded thereto, which tubes receive suitable terminal bushings 31 and 32 in any desired manner.

The terminal bushings 31 and 32 then have central conductors 44 and 45, respectively, which are terminated with jaw type contacts 46 and 47, respectively, which receive movable contact assembly 48 and stationary contact assembly 49, respectively, as will be later described.

Figure 5:
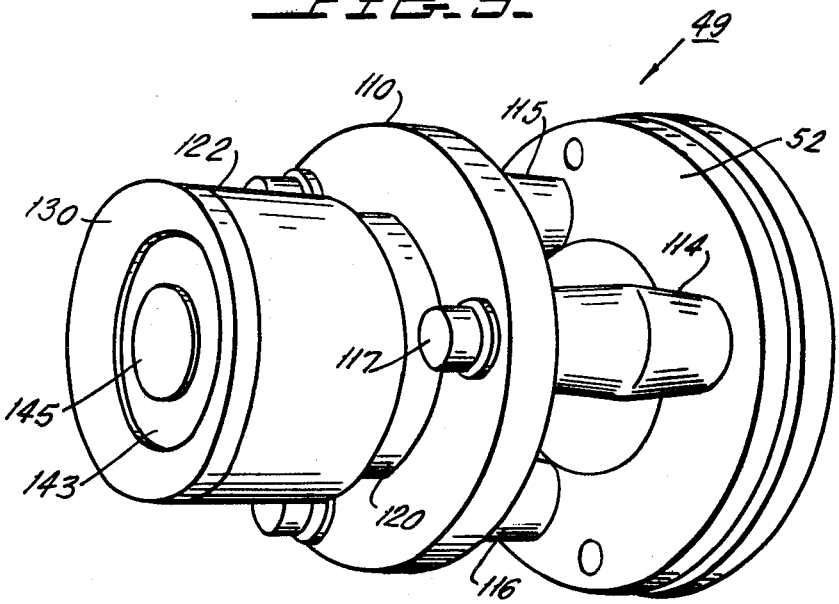
FIG. 5 is a perspective view of the stationary contact and arc runner shown in FIG. 4.
Figure 9:
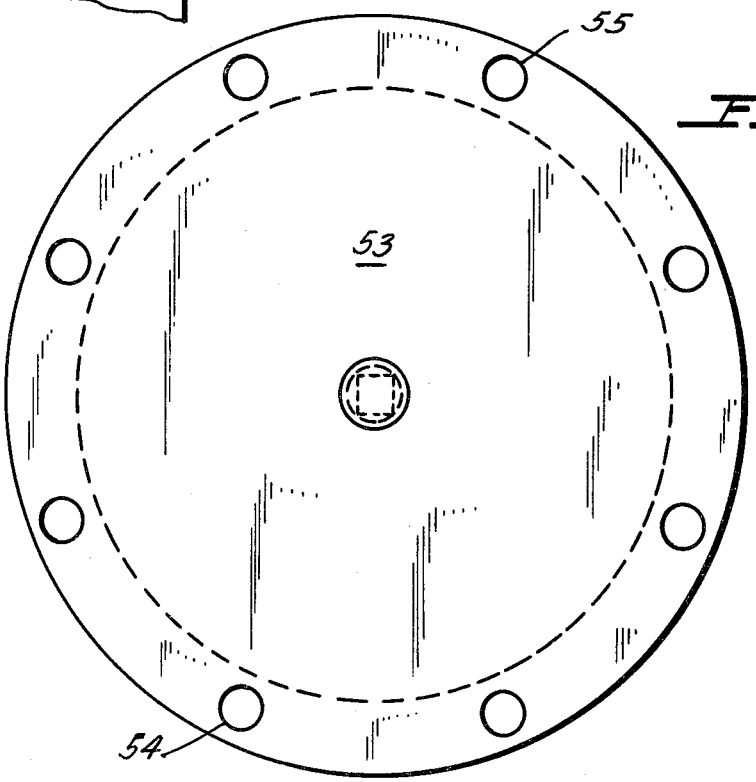
FIG. 9 is an end view of the right-hand end of FIG. 4.

The right-hand end of housing 26 is capped by an end assembly including seal ring 50 (FIG. 4) which contains a sealing gasket 51 (FIG. 4), an aluminum support plate 52 (FIGS. 4 and 5) and an end cap plate 53 which may be of steel. Ring 50 is welded to the right-hand end of tube 26 and provides a bolt-hole ring. The aluminum disk 52 is held in the position shown by the plate 53 when the plate is bolted to the ring 50 as by the bolts 54 and 55 shown in FIG. 4. Note that plate 53 is shown in both FIG. 4 and FIG. 9 and, when the plate 53 is bolted up against the ring 50, it forms a leak-proof seal against the sealing ring 51.

Figure 7:
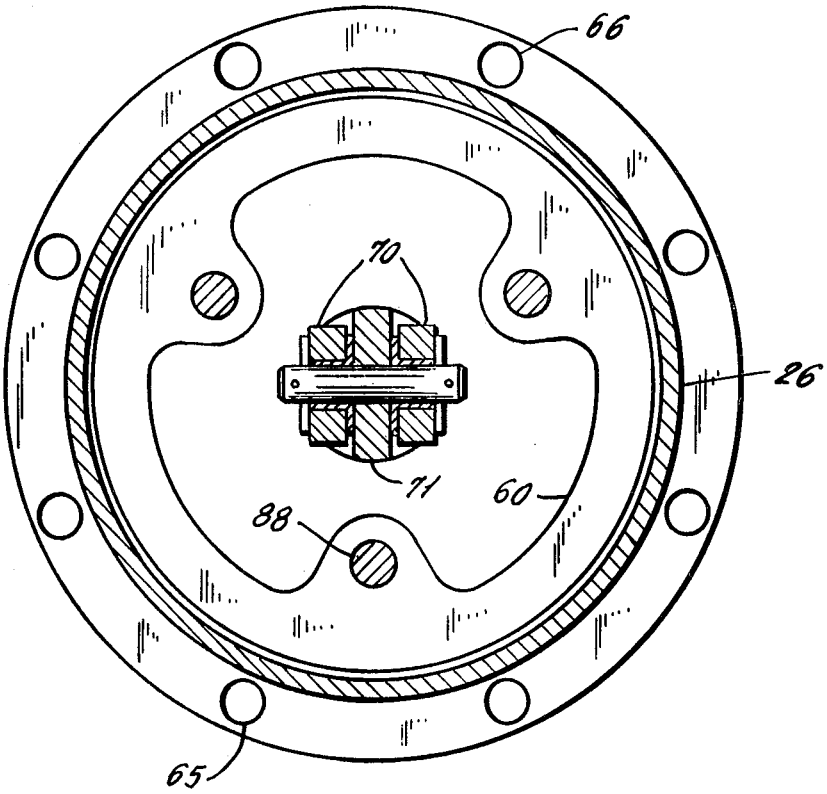
FIG. 7 is a cross-sectional view of FIG. 4 taken across the section line 7—7 in FIG. 4.

The opposite end of tube 26 has a bolt ring 60 welded thereto which has a three-lobe type opening as best shown in FIG. 7. A short tube section 61 is then provided with a sealing ring 62 connected to its end which receives a sealing gasket 63. The outer diameter of ring 62 contains a bolt ring circle having bolt openings in alignment with the bolt openings in member 60 so that bolts, such as bolts 65 and 66 in FIGS. 4 and 7, can secure together housing sections 26 and 61 with a good gas-tight seal being formed by the seal 63.

The left-hand end of section 61 is then welded into an opening in the tank 35 as shown. Thus, the interior of tube 26 and of the various elements with which it communicates are sealed from the external atmosphere and the interior of tube 26 is filled with sulfur hexafluoride at a pressure of about 3 atmospheres absolute. Note, however, that any desired pressure could be used and that any dielectric gas other than sulfur hexafluoride or combinations of dielectric gases as desired could be used in place of sulfur hexafluoride.

Figure 6:
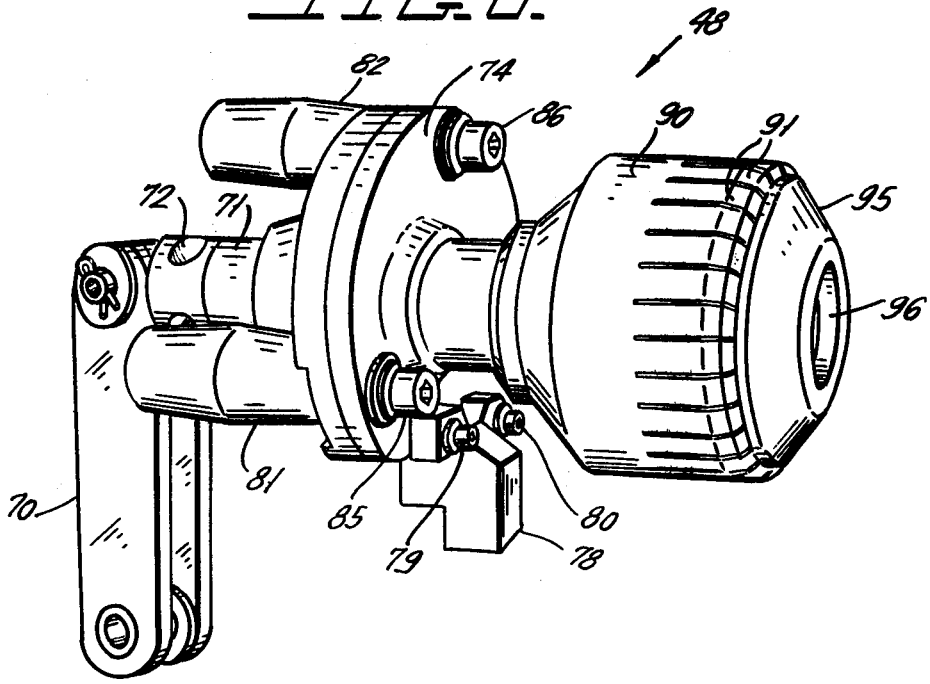
FIG. 6 is a perspective view of the movable contact assembly of FIG. 4.

The movable contact assembly 48 is best shown in FIGS. 4 and 6. The movable contact assembly is connected to the operating crank 38 of FIG. 4 which is driven by the operating mechanism through a connecting link 70 which is pivotally connected to the end of elongated axially movable conductive member 71. Movable member 71 is a conductive elongated hollow rod having a closed end at its left where the closed end portion at its left-hand end is provided with a plurality of vents such as vents 72 and 73 which, as will be described hereinafter, permit flow of gas and arc plasma through the movable contact and through these vents during an interruption operation.

Movable member 71 is guided for motion by a stationary conductive support member 74 which contains a sliding contact member 75 (FIG. 4) which maintains electrical sliding contact with the conductive tube 71. A suitable insulation layer 76 (FIG. 4) can be fixed to member 74 to provide relatively low friction guiding of the movable member 71. Contact 75 is then held in place by a suitable conductive backup plate, such as plate 77, which is held in place by suitable screws.

Conductive stationary support member 74 is also provided with an upwardly extending conductive tab 78 which is fixed to member 74 by bolts 79 and 80 (FIG. 6) and the tab 78 engages the jaw contact 46 when the device is assembled. The support member 74 is then fixed to the ring 60 by three insulation support members 81 and 82 (FIG. 6) and 83 (FIG. 4) which may be molded epoxy members. The righthand end of each of these members is bolted to member 74 as by bolts 85, 86 and 87, respectively, and their opposite ends are bolted to member 60 as by the bolt 88 shown in FIG. 4 for the case of insulation support member 83. Similar bolts connect the other insulation supports to the member 60 but are not shown in the drawings. Thus, the movable contact assembly is insulatably supported from the housing 26.

The main movable contact element then consists of a bulbous contact member 90 which is terminated by a plurality of segmented contact fingers 91.

Member 90 defines an outwardly looping current path from the centrally located conductive member 71 and may be suitably electrically connected to the end of member 71 as by a threaded connection to the intermediate conductive ring 92 which is, itself, threaded to the end of member 71. Intermediate member 92 also serves as a seat for compression spring 93 which is pressed against the inner diameter of the interior sliding arcing contact member 95. Arcing contact 95 has a central opening 96 at its outer diameter and receives a suitable nonconductive ring 97 which enables member 95 to slide relatively easily with the fingers 91. Note that the ends of fingers 91 bend inwardly to define a shoulder 99 which engages the shoulder 100 when the fingers move to the left while the interrupter is opening.

Figure 8:
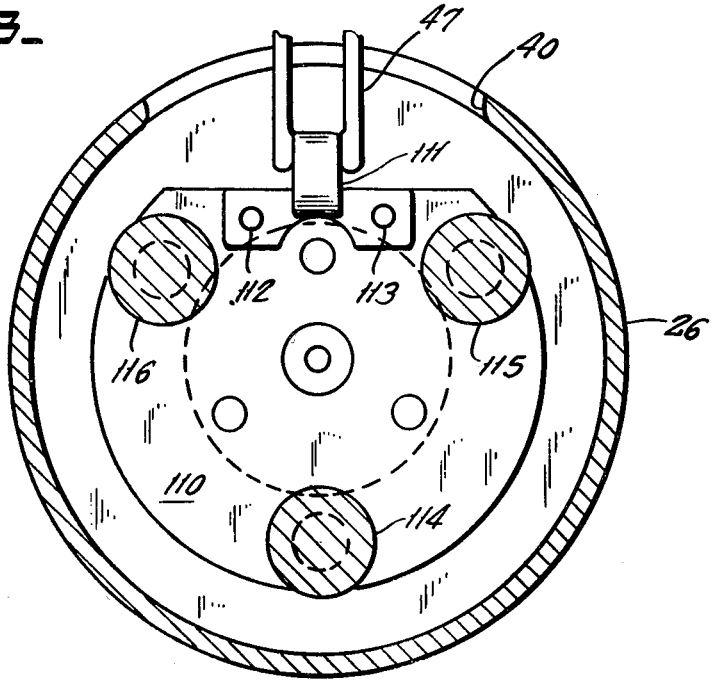
FIG. 8 is a cross-sectional view of FIG. 4 taken across the section line 8—8 in FIG. 4.

The stationary contact structure 49 is best shown in FIGS. 4 and 8. Stationary contact structure 49 has a main support housing section 110 which may be of aluminum and has a tab 111 extending therefrom and bolted thereto as by the bolts 112 and 113. Tab 111 is then received by the jaw contact 47 to make connection between the stationary contact assembly and the terminal bushing 32.

Support member 110 then has three epoxy support members 114, 115 and 116 bolted thereto as by bolts such as the bolt 117 shown in FIG. 4 for the case of member 114. The support members 114 to 116 are then in turn bolted to the aluminum disk 52 as by bolts such as bolt 118 shown in FIG. 4 for the case of member 114.

Thus, the entire stationary contact assembly is insulatably secured from the main support casing 26.

Member 110 has an intermediate aluminum support member 120 (FIGS. 4 and 4*b*) bolted thereto as by bolts such as bolt 121 shown in FIG. 4 and a main stationary contact sleeve 122 is threadably connected or otherwise suitably connected to the member 120. The end of member 122 may have a contact ring insert 123 which may be of a material which can resist arc erosion, such as copper-tungsten or the like for receiving the inner ends of contact fingers 91 of the movable contact when the interrupter is closed, and for forming a good solid low-resistance current conduction path between contact assemblies 48 and 49. Note that fingers 91 are outwardly and elastically pressed when they engage member 122 to provide high pressure contact. The end of the contact sleeve 122 is then terminated by a Teflon ring 130 which generally covers the outer end of the stationary contact assembly and has the generally trapezoidal cross-sectional shape shown. Ring 130 can be secured in place relative to member 122 as by threading or the like.

The stationary contact assembly shown in FIG. 4 further contains a copper coil support member 140 which consists of a central core or hub section 141 which has a central opening 142 therein, and two integral spaced flanges 143 (FIG. 4*b*) and 143*a* extending from core 141. Flange 143 acts as an arc runner and is a generally washer shaped conductive plate which may be of a chromium copper material. Rear flange 143*a* is preferably slotted to discourage circulating current. Coil support 140 should be sufficiently strong to withstand forces of repulsion which tend to repel the coil winding and the arc runner 143. A Teflon or other insulation material nut 145 covers the interior surface of arc runner 143 and defines an annular shaped exposed contact area for arc runner 143.

Insulation members 148 and 149 (FIG. 4*b*) are disposed between copper coil support member 140 and sleeve 122 to prevent their accidental contact. The space between arc runner 143 and flange 143*a* receives a winding 150 which is a spiral winding, for example, consisting of eleven concentric flat turns which are insulated from one another. If desired, the turns of winding 150 can be made of other cross-section shapes, and could, for example, be square in cross-section. The interiormost coil of winding 150 is electrically connected to the central hub 141 while the outermost coil of winding 150 is electrically connected to member 120 by the conductive strap 151. Thus, an electrical connection is formed from terminal 11 through member 110, member 120, conductive strap 151, winding 150, and to the hub 141 of member 140. In the embodiment of FIG. 4, current is connected to arc runner 143 at its interior. Current is introduced into hub 141 from coil 150, and is then connected directly to the interior diameter of arc runner 143.

Figure 10:
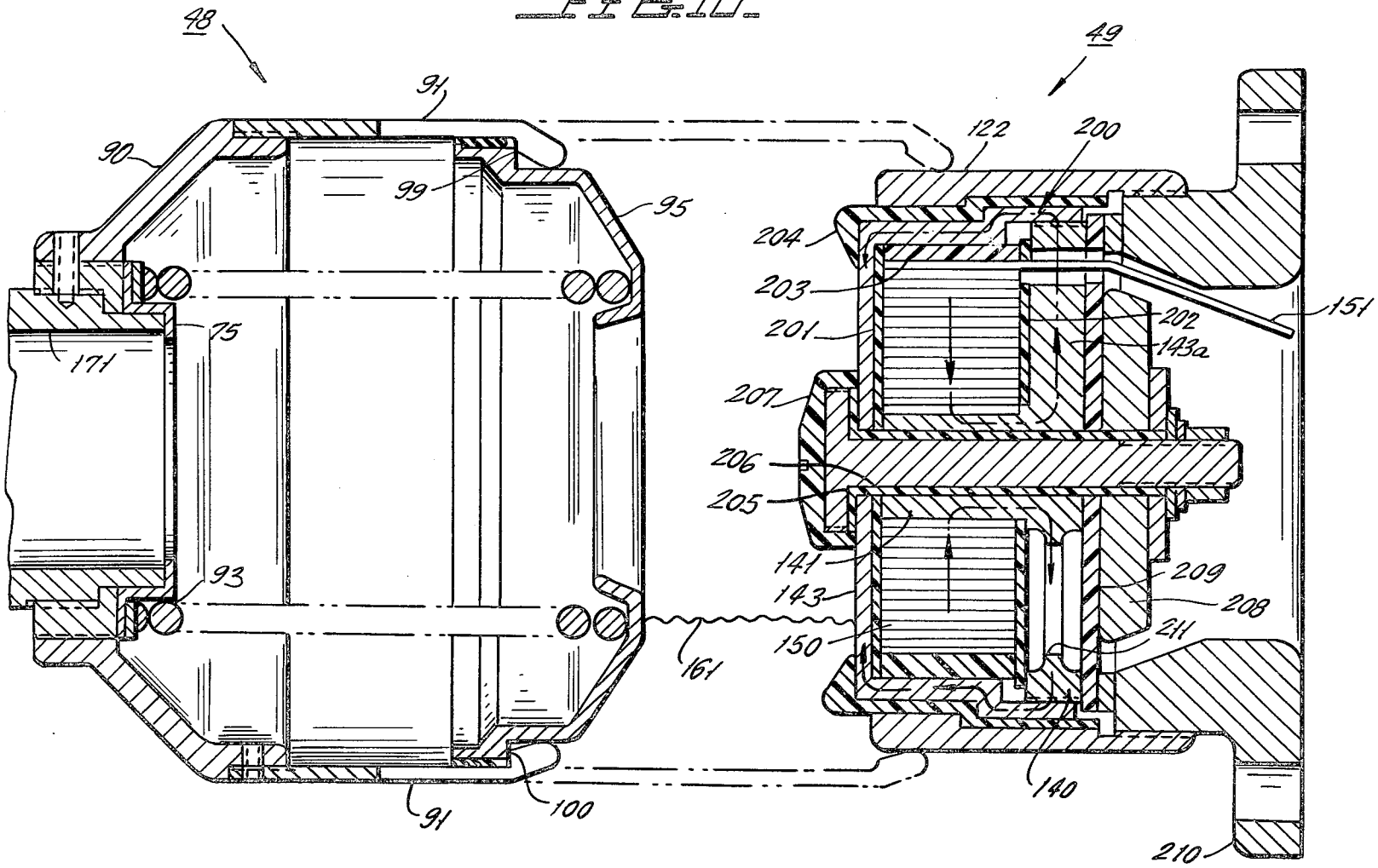
FIG. 10 is an enlarged view of the stationary contact and arc runner of FIG. 4 modified in accordance with the invention so that current to the arc runner is connected at its outer diameter.

An important feature of this invention, as will be shown in connection with FIG. 10, is that there can be an outside feed of current to arc runner 143, whereby the outer diameter of flange 143*a* is connected to the outer diameter of the arc runner 143. The current path for either inside or outside feed to arc runner 143 is schematically shown in FIG. 4*a*. Suitable insulation layers are provided as necessary to define the inside or outside-fed connection to the arc runner 143. FIG. 10, which will be later described, shows the outside feed in detail.

In the construction described to this point, it can be seen that the assembly of the interrupter is simplified by the removable connection between the movable and stationary contact assemblies 48 and 49 with the jaw contacts 46 and 47 for the terminal bushings 31 and 32.

The current path through the interrupter, when the interrupters are in the closed position shown below the center line in FIG. 4, is as follows:

Current enters terminal 31 and flows through jaw contact 46 and tab 78 and is then connected to the conductive member 71 through the sliding contact 75. Current then flows axially outwardly into movable contact member 90 and then through the contact fingers 91 and into contacts 123 and 122. Current then continues to flow into member 120 and member 110 and then through the tab 111 into the the jaw contact 47 and then out of the bushing 32.

In order to open the interrupter contacts, the operating mechanism causes link 38 to rotate counterclockwise in FIG. 4, thereby moving conductive member 71 to the left. During the initial opening motion, the contact fingers 91 move to the left in FIG. 4 so that the main contacts open and electrical current flow is commutated from the main contact into the arcing contact 95, which is still engaged with the arc runner 143, coil 150, and then through members 120 and 110 to tab 111.

Contact 95 may be of a copper chromium material or some other material well suited to withstand arcing duty. The arcing contact 95 is initially strongly held against the arc runner 143 under the influence of the spring 93. Once the movable contact fingers 91 have moved sufficiently far to the left, however, shoulder 99 of the fingers 91 pick up shoulder 100 of arcing contact 95 and, for the first time, the arcing contact 95 begins to move to the left, and out of contact with arc runner 143. An arc is then drawn between the arc runner surface 143 to the arcing contact 95 which arc current flows in series with the coil 150.

The current through coil 150 then sets up a magnetic field which has a component extending perpendicularly through the arc current flowing between arc runner 143 and contact 95. At the same time, since coil 150 is very closely coupled to the arc runner 143 (which is a short-circuited turn), a circulating current is induced in the arc runner 143. This circulating current is phase-shifted relative to the arc current and the current in coil 150. The current in the coil 150 and the circulating current in runner 143 produce a magnetic field in the arc space, which field has a component which is perpendicular to the arc current. The arc current and the magnetic field interact to produce a Lorentz force on the arc, thereby causing the arc to rotate rapidly around the axis of runner 143 and contact 95. Consequently, the arc spins rapidly through the relatively stationary dielectric gas, thereby to cool and deionize the arc so that it will extinguish at current zero.

Improved operation is obtained when current applied to the arc runner 143 is applied at its outer diameter, so that a blow-in magnetic force is applied to the arc current, causing it to bend toward the axis of rotation of the interrupter.

Figure 11:
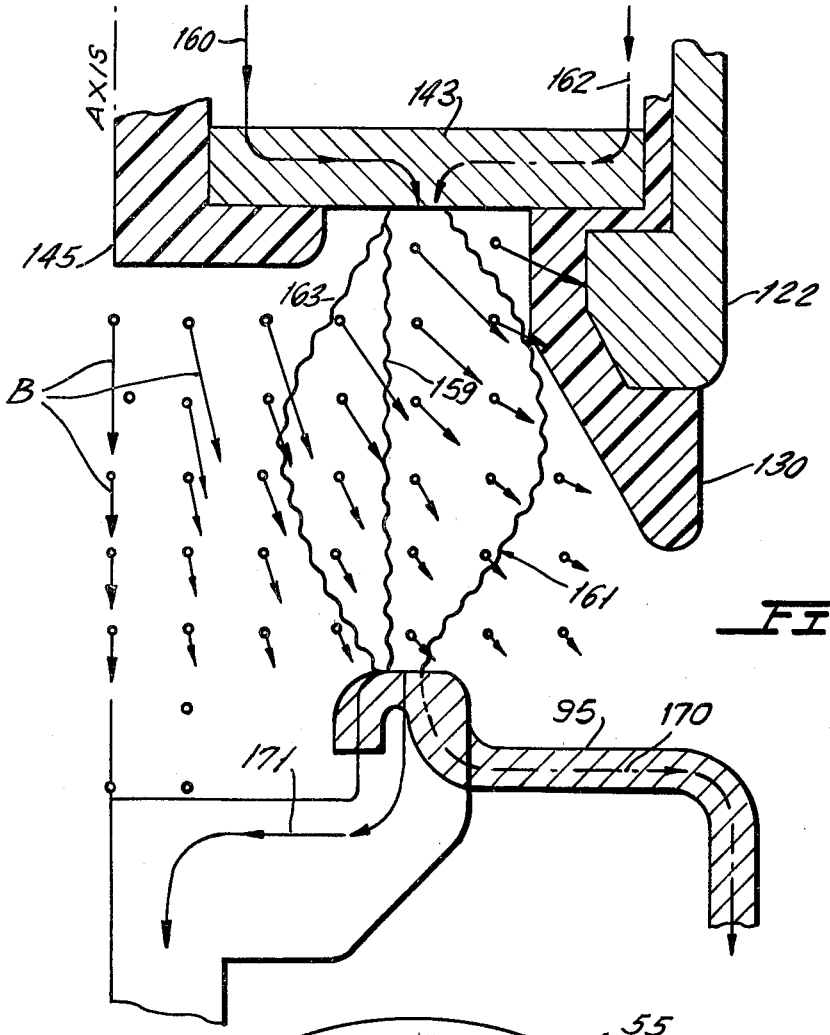
FIG. 11 schematically illustrates the arc current between the arc runner and the movable arcing contact for different conditions of current feed to the inside and outside of the arc runner and further shows different conditions of current flow, for inside feed and outside feed to the arcing contact.

The effect of the outside feed to the arc runner can be best understood by a consideration of FIGS. 4 and 10 with 11. FIG. 11 schematically illustrates a few of the disclosed stationary contact assembly components with identifying numerals corresponding to those of FIGS. 4 and 4*b* and displays the different arc and field configurations when using inside outside and inside feed current paths.

FIG. 10 shows the movable contact assembly 48 of FIG. 4 along with a stationary contact assembly 49 which is modified for outside feed of current. Thus, in FIG. 10, arc runner 143 is modified to have a cup shape, and has cylindrical wall 200 which extends coaxially over winding 150, and is threadably engaged to the outer periphery of flange 143*a*. Suitable insulation disks 201 and 202 and insulation cylinder 203 insulate coil 150 from cylindrical wall 200, runner 143 and flange 143*a*. Insulation sleeve 204 insulates contact sleeve 122 from the conductive wall 200.

Lead 151 is connected to the outermost coil of winding 150, and its innermost coil is connected to hub 141. The arc runner 143 is mechanically held closely coupled to coil 150 by steel bolt 205 which is sheathed with insulation, such as Teflon cylinder 206 and Teflon cap 207. Bolt 206 presses against plate 208 and insulation disk 209 as shown.

Contact 122 in FIG. 10 is threaded onto a conductive support 210 which, as in FIG. 4, is suitably connected to member 110 and terminal bushing 32.

It should be noted that flange 143*a* is slotted as by slot 211 at one or more places on its periphery to avoid inducing a circulating current around flange 143*a*.

It will be clear from FIG. 10 that the current path to arc runner 143 will follow the path of the arrows so that current will be connected to runner 143 around its full outer periphery. The effect of this outside feed of current is best understood from FIG. 11 which schematically shows the arc runner 143 for different current feed conditions.

FIG. 11 illustrates, by graduated arrows, the magnetic flux density field B plotted across the pertinent regions of the area through which the arc between arc runner 143 and movable arcing contact 95 will travel. It will first be noted that the intensity of the magnetic field is greatest closest to the arc runner 143. This is because the magnetic field B is produced by the circulating current in member 143 and also by the coil 150 which is disposed behind member 143. Thus, as the distance from coil 150 and member 143 increases, the field strength is reduced. At the same time, the direction of the field vector varies over the area and is seen to be parallel to the interrupter axis at regions along the axis of member 143 and then becomes closer to a perpendicular to the axis of member 143, progressing radially outward from the axis.

The force which is exerted on the arc current drawn between arc runner 143 and movable arcing contact 95 is given by the vector cross product between the magnetic field B and the arc current. Thus, the closer to perpendicular the arc current is to the field vector, the greater will be the force tending to rotate the arc around the annular arc runner area.

If the current coming into arc runner 143 was straight and parallel to the axis of runner 143 and in the absence of other disturbing forces, the arc current would take the path 159. Thus, the arc current would have a relatively large component perpendicular to the various field vectors B to produce a rather high rotating force.

In the prior art, however, current is introduced to the arc runner 143 at the inside diameter of the arc runner. Thus, current has taken the path shown in the solid line 160. Because of the bend in the current 160, a magnetic blow-off force will be exerted on the arc current, and the arc current will follow the outwardly bowed path 161. Because of this, the arc current in the high field region near the arc runner 143 will be more parallel to the magnetic field vector B, so that a relatively low rotating force will be applied to the arc current. Moreover, the arc 161 is outwardly blown, thus leading to the possible danger that the arc will transfer back to the main contact 122.

In accordance with the invention, the current feed is to the outside of the arc runner 143, as shown by the dotted-line path 162 in FIG. 11. This then produces a blow-in or inward magnetic force on the arc, which is directed toward the axis of the arc runner 143, thereby to cause an inward bowing of the arcing current as shown by the arc current path 163. Note that the maximum inward bowing occurs closest to the arc runner 143, where the magnetic field B is the highest. Thus, in these very high intensity regions, the arc current is almost perpendicular to the magnetic field, thus producing extremely high rotating forces on the arc. Moreover, the arc 163 is blown away from the outside, thereby minimizing the danger of a flashover to the main contact members.

The opposite end of the arc root is on the arcing contact 95 as shown in FIG. 11. An important aspect of the new device is that the current flow through the arcing contact 95 is radially outward, and over the dotted-line path 170 rather than the prior art type of inside feed to the arcing contact, shown in the solid line 171 path.

By causing the current path through the arcing contact to be an outside feeding path, current in the moving contact 95 flows in the radially outward path from the arc root region and from the axis of the movable contact. Thus, there is an inward blow-off force applied to the arc root and to the arc in the region of the arcing contact 95. That is to say, the arc will tend to be moved inwardly toward the axis of the arcing contact 95 rather than outwardly, as would occur for an inside feed along the path 171 as in the prior art. This tends to maintain arc position on the most radially inward portion of the arcing contact so that arc position and arc length is maintained to minimize arc energy input to the gas and to prevent a flashover to the main contact.

It was previously pointed out, with respect to FIGS. 4 and 6, that the movable contact member 71 had openings such as openings 72 and 73 therein. Other openings are also distributed around the left-hand end of member 71. It has been found that these openings will assist in the removal or distribution of arc plasma which is produced during arcing. Thus, it has been found desirable to have some means for directing the arc plasma away from the arc zone during the interruption operation in order to move the arc plasma away from the main stationary contact.

By providing openings 72 and 73 or other similar openings along the length of conductor 71, the intense heat produced by the plasma in the region between the separating contact 95 and runner 143 will act as a source to cause hot gases to move to the left along the axis of the tube 71 and then out through the openings of the tube. That is to say, the openings, such as openings 72 and 73, help define a flow channel along the center of the moving contact along which the hot gases can move in order to remove excess hot gases from the arcing zone.

This is extremely useful at higher current levels, where large amounts of hot gases are produced. It also has limited use in connection with low current interruption where a limited amount of hot gas is produced. However, in the case of low current interruption, it is useful to provide means for producing a negative pressure region within contact 71 to permit movement of at least a limited amount of gas away from the arc zone. This could be accomplished, for example, by blocking substantially the full interior of conductor 71 with a light insulation filler material and leaving a relatively small gas volume sufficient only to allow full movement of the arcing contact 95 to the right, relative to the movable contact when the contact opens. This limited movement will then cause a proportionally large increase in the volume to the left of contact 95 during opening, thereby to produce a negative pressure zone into which a limited amount of gas could flow under low current interruption conditions.

Although a preferred embodiment of this invention has been described, many variations and modifications will now be apparent to those skilled in the art, and it is preferred therefore that the instant invention be limited not by the specific disclosure herein but only by the appended claims.

We claim:

1. A circuit interrupter comprising a stationary contact assembly; a movable contact assembly; a dielectric gas-filled housing containing said stationary and movable contact assemblies; said stationary contact assembly including an arc runner contact and an electrical coil for spinning an arc which extends from said arc runner contact and circuit connection means for connecting said electrical coil in series with said arc runner contact; said arc runner contact comprising a generally flat conductive disk having an axis which is coaxial with the axis of said coil; said coil being disposed adjacent one surface of said arc runner contact and being in a plane parallel to the plane of said arc runner contact and being closely magnetically coupled to said arc runner contact; said movable contact assembly including a generally cylindrical arcing contact which is coaxial with said arc runner contact, and which is movable into and out of contact with a second surface of said arc runner contact which is opposite to said one surface; said arcing contact comprising a cup-shaped member having a small diameter annular contact surface for engaging a cooperating annular surface region of said second surface of said arc runner contact; said cup-shaped member having a generally cylindrical portion having a diameter larger than that of said small diameter surface and having an axial component extending away from said arc runner contact, whereby current flow in said arcing contact executes an outward bend at the region where an arc roots on said small diameter contact surface, thereby to produce a magnetic force on said arc adjacent said small diameter surface which tends to move said arc radially inward toward the axis of said cup-shaped member; said small diameter annular contact surface being planar whereby the arc between said small diameter annular contact surface and said arc runner contact has substantially the same length regardless of the location of said arc root on said small diameter surface.

2. The device of claim 1 wherein said arcing contact has an axial opening in the center thereof which defines the innermost diameter of said small diameter annular contact surface.

3. The circuit interrupter of claim 1 which further includes a main movable contact connected in parallel with said arcing contact, and a main stationary contact supported on said stationary contact assembly; said main movable contact being movable with said arcing contact and being movable into and out of engagement with said main stationary contact.

4. The device of claim 3 wherein said main movable contact comprises a conductive cylinder having segmented contact fingers at the outer end thereof; said cylindrical arcing contact being slidably mounted within said main movable conductive cylinder.

5. The device of claim 4 which further includes biasing means for said main movable and arcing contacts for biasing said arcing contact toward the open end of said main contact and into engagement with said arc runner contact.

6. The circuit interrupter of claim 1 wherein the outer periphery of said arc runner contact is covered with a solid dielectric material.

7. The circuit interrupter of claim 1 wherein the center of said opposite surface of said arc runner contact is covered with a solid dielectric.

8. The circuit interrupter of claim 1 wherein the dielectric gas filling said dielectric gas-filled housing at least includes $SF_6$.

9. An arc spinner interrupter comprising, in combination:

first and second electrical terminal means;

a movable contact movable along an axis, and between an engaged and a disengaged position;

annular arc runner means disposed in a plane perpendicular to the direction of movement of said movable contact and having an axis which is coaxial with said axis of movement of said movable contact; said annular arc runner means being electrically engaged by said movable contact when said movable contact is in its said engaged position; said arc runner means defining a path for the annular rotation of the arc root of an arc which is drawn between said arc runner means and said movable contact when said movable contact moves to its said disengaged position;

dielectric gas filling the space which will be occupied by an arc drawn between said movable contact and said arc runner means;

magnetic field generating means for producing a magnetic field in said space, which field has at least one component which is perpendicular to said axis of said arc runner means, thereby to produce a Lorentz force which rotates said arc relative to said dielectric gas;

first circuit means connecting said movable contact to said first terminal means;

and second circuit means connecting said annular arc runner means to said second terminal means; said contact comprising a cup-shaped member having a small diameter annular contact surface for engaging a cooperating annular surface region of said annular arc runner means; said cup-shaped member having a generally cylindrical portion having a diameter larger than that of said small diameter surface and having an axial component extending away from said arc runner means, whereby current flow in said movable contact executes a single outward bend at the region where an arc roots on said small diameter contact surface, thereby to produce a magnetic force on said arc adjacent said small diameter surface which tends to move said arc radially inward toward the axis of said cup-shaped member.

10. The device of claim 9 wherein said contact has an axial opening in the center thereof which defines the innermost diameter of said small diameter annular contact surface.

11. A movable contact assembly for an arc spinner interrupter; said movable contact assembly comprising an elongated axially movable conductive member; means for making sliding connection between said elongated conductive member and a relatively stationary terminal; a main movable contact cylinder fixed to one end of said elongated conductive member and having an outer diameter greater than that of said elongated conductive member; the outer end of said main movable contact cylinder being terminated by a plurality of slotted contact fingers adapted to telescopingly engage a cooperating stationary contact cylinder; and an arcing contact comprising a cup-shaped member having a relatively small diameter outer annular arcing contact surface, and having a generally cylindrical portion having a diameter larger than that of said small diameter surface, but less than said outer diameter of said main contact cylinder; said cup-shaped member being slidably and coaxially disposed within said main contact cylinder, whereby current flow in said arcing contact executes a single outward bend at the region where an arc roots on said small diameter contact surface, thereby to produce a magnetic force on the arc adjacent said small diameter surface which tends to move said arc radially inward toward the axis of said cup-shaped member.

12. The device of claim 11 wherein said arcing contact has an axial opening in the center thereof which defines the innermost diameter of said small diameter annular contact surface.

13. The device of claim 11 which further includes biasing means for said main movable and arcing contacts for biasing said arcing contact toward said outer end of said main contact cylinder and into engagement with said arcing contact.

* * * * *